US006786804B2

(12) United States Patent
Watanabe

(10) Patent No.: US 6,786,804 B2
(45) Date of Patent: Sep. 7, 2004

(54) SIDING BOARD FOR CLAPBOARD BOARDING AND A CLAPBOARD BOARDING STRUCTURE

(75) Inventor: Morimichi Watanabe, Aichi-ken (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

(21) Appl. No.: 10/197,585

(22) Filed: Jul. 18, 2002

(65) Prior Publication Data

US 2003/0014936 A1 Jan. 23, 2003

(30) Foreign Application Priority Data

Jul. 19, 2001 (JP) ..... 2001-220290

(51) Int. Cl.[7] ..... B24B 1/00
(52) U.S. Cl. ..... 451/54; 451/55
(58) Field of Search ..... 451/54, 55, 67, 451/68, 69, 70; 428/15, 172, 141

(56) References Cited

U.S. PATENT DOCUMENTS 3,616,103 A * 10/1971 Greiner et al. ..... 428/15
5,072,562 A 12/1991 Crick et al.
5,076,037 A 12/1991 Crick et al.
5,249,402 A 10/1993 Crick et al.
5,347,784 A 9/1994 Crick et al.
5,537,792 A 7/1996 Moliere

FOREIGN PATENT DOCUMENTS

| | | |
|---|---|---|
| JP | 62-55366 | 3/1987 |
| JP | 07-089006 | 4/1995 |
| JP | 09-144279 | 6/1997 |
| JP | 10-088769 | 4/1998 |
| JP | 2001-059325 | 3/2001 |

* cited by examiner

*Primary Examiner*—M. Rachuba
(74) *Attorney, Agent, or Firm*—Oblon, Spivak, McClelland, Maier & Neustadt, P.C.

(57) ABSTRACT

Siding boards for clapboard boarding are used in a clapboard boarding structure in which lower side portions of upper siding boards are overlapped frontward of upper side portions of lower siding boards for installing a plurality of siding boards to a framework of a building. The siding boards are ceramic type siding boards with vertical joint grooves being formed on designed surfaces. Lower edges of the lower side portions of the siding boards are formed at different heights with the boundaries of the vertical joint grooves. Rear surface stepped portions that have been obtained by notching the rear surface are formed at the lower side portions. Upper end portions of the rear surface stepped portions are formed in a substantially straight line in lateral directions.

3 Claims, 16 Drawing Sheets

SIDING BOARD FOR CLAPBOARD BOARDING AND A CLAPBOARD BOARDING STRUCTURE

CROSS-REFERENCES TO RELATED APPLICATIONS

The present application claims priority under 35 U.S.C. §119 to Japanese Patent Application No. 2001-220290, filed Jul. 19, 2001, entitled "SIDING BOARD FOR CLAPBOARD BOARDING AND A CLAPBOARD BOARDING STRUCTURE". The contents of this application are incorporated herein by reference in their entirety.

BACKGROUND OF THE INVENTION

1. Field of the Invention

The present invention relates to a clapboard boarding structure wherein lower side portions of upper siding boards are overlapped frontward of upper side portions of lower siding boards for installing a plurality of siding boards to a framework of a building, siding boards for clapboard boarding used therein, and a method for manufacturing the same.

2. Discussion of the Background

As a known external wall structure for a building, there is such a clapboard boarding structure 9 as illustrated in FIG. 13. When assuming one siding board 8 as a positional standard, a lower side portion 81 of another siding board 8 which disposed above the standard siding board 8 is overlapped frontward of an upper side portion 82 of the standard siding board 8, and the two siding boards 8 are fastened to a framework 3 by nailing a nail 49 from a surface of the lower side portion 81. This basic construction is repeated, thereby building the clapboard boarding structure 9.

Such a clapboard boarding structure 9 is built by installing a plurality of siding boards 8, which are lateral elongated shaped and made of wood, on a framework 3 in vertical directions.

However, such a clapboard boarding structure 9 has a disadvantage that the use of siding boards 8 of laterally elongated shape will result in a monotonous external appearance in view of an appearance in the lateral direction.

In view of this point, there has been proposed a clapboard boarding structure 90 constructed in the same manner as the above-described clapboard boarding structure 9 (that is, aligning a plurality of siding boards 80 in vertical directions in a partially overlapping manner and fastening them to a framework 3 by means of nails 49) by using siding boards 80 obtained by laterally aligning and mounting a plurality of wooden single plates 88 onto an underlayment board 89 of a laterally elongated shape, as illustrated in FIGS. 14 to 16.

A longitudinal directional dimension of each wooden single plate 88 is larger than that of the underlayment board 89, and a lateral directional dimension of each wooden single plate 88 is sufficiently smaller than that of the underlayment board 89 as shown in FIGS. 14, 15. Moreover, the sizes of the respective wooden single plates 88 differ from each other.

With this arrangement, it is possible to obtain a clapboard boarding structure 90 with an external appearance as if the wooden single plates 88 of various shapes were individually mounted. More specifically, every wooden single plate 88 will produce different patterns and shapes so that it is possible to obtain an external wall having a touching external appearance with superior design. Construction will also be simplified by employing siding boards 80 of laterally elongated shapes.

However, such a clapboard boarding structure 90 has a disadvantage that the number of processes for manufacturing the siding boards 80 will be large since the siding boards 80 are obtained by mounting wooden single plates 88 onto the underlayment boards 89. The fact that the siding boards 80 are made of wood also may result in insufficient weatherability and durability of the clapboard boarding structure 90.

It has thus been considered to obtain a clapboard boarding structure employing ceramic type siding boards to produce an external appearance similar to the above-described clapboard boarding structure 90 as if single plates of various shapes were mounted thereon. More particularly, siding boards in which vertical joints are provided on designed surfaces of them and lower edges of lower side portions are arranged irregularly are formed of cement.

In such a case, vertical joints of the designed surface are formed through embossing at the time of manufacturing original plates. It is difficult to form the lower edges of the lower side portion at various positions through a grinding process owing to the complicated outlines thereof. It will thus be necessary to perform a punching process of semi-fabricated products prior to curing of the cement during the molding. Therefore, since large-sized siding boards are apt to deform, it will be difficult to obtain long siding boards.

It will consequently be necessary to perform construction by aligning a plurality of small siding boards in horizontal directions for obtaining such a structure. Therefore constructing a clapboard boarding is difficult.

SUMMARY OF THE INVENTION

An object of the present invention is to provide a siding board for clapboard boarding which is easily manufactured and enables easy construction of a clapboard boarding structure exhibiting superior external-appearance design, weatherability and durability, a method for manufacturing the same, and a clapboard boarding structure that can be obtained thereby.

According to one aspect of the invention, there is provided a siding board for clapboard boarding that is employed in a clapboard boarding structure in which a plurality of siding boards are installed to a framework of a building such that lower side portions of upper siding boards are overlapped frontward of upper side portions of lower siding boards, wherein the siding board is a ceramic type siding board having vertical joint grooves on a designed surface thereof, lower edges of a lower side portion formed at different heights with boundaries of the vertical joint grooves, a rear surface stepped portion formed on the lower side portion, which has been obtained by notching a rear surface of the siding board, and an upper end surface of the rear surface stepped portion formed to extend in a substantially straight line in lateral directions.

The siding board is formed with the vertical joint grooves on the designed surface thereof, and lower edges-of the lower side portion are formed at different heights with boundaries of the vertical joint grooves. Thus, the designed surface of the siding board is partitioned by the vertical joint grooves. Moreover, lower ends of the respectively partitioned designed surface are disposed at different positions. The siding board is employed in constructing a clapboard boarding structure, wherein the lower edges are exposed when in a constructed condition. Thus, it is possible to obtain a clapboard boarding structure that exhibits an external appearance as if a plurality of single plates of different sizes were mounted, that is touching and rich in variation, and that is of superior external-appearance design, when in a constructed condition.

Since the siding board may be a long siding board of a shape as if a plurality of single plates were integrated, construction thereof is made easy.

Since the siding board is a ceramic type siding board; it exhibits superior weatherability and durability. Moreover, since various concave and convex patterns may be easily formed on the designed surface, it is possible to obtain a large variety of external-appearance design.

Further, the rear surface stepped portion which has been obtained by notching the rear surface is formed on the lower side portion of the siding board. Thus, by overlapping the rear surface stepped portion of an upper siding board onto an upper end portion of a lower siding board, it is enabled to construct a clapboard boarding structure easily and reliably.

Since the upper end surface of the rear surface stepped portion is formed to extend in a substantially straight line in a lateral direction, the rear surface stepped portion may be easily formed through a grinding process or others, and the siding board may thus be easily manufactured.

As discussed above, it is possible to provide a siding board for clapboard boarding that may be easily manufactured, with which it is possible to easily construct a clapboard boarding structure that is of superior external-appearance design, weatherability and durability.

According to another aspect of the invention, there is provided a method for manufacturing a siding board for clapboard boarding that is employed in a clapboard boarding structure in which a plurality of siding boards are installed to a framework of a building such that lower side portions of upper siding boards are overlapped frontward of upper side portions of lower siding boards, the method including the steps of: embossing a green sheet to make an embossed board prior to curing of cement for forming joint concave portions at portions that are to be vertical joint grooves of the siding boards and for forming lower concave portions below portions that are to be lower edges of the siding boards, in which the lower concave portions have different vertical widths with the boundaries of the joint concave portions; curing the cement of the embossed board; and grinding down lower side portions of the embossed board horizontally across the embossed boards from a rear surface side thereof up to a bottom surface of the lower concave portions to form rear surface stepped portions and to form lower side portions of the siding board having lower edges at different heights with boundaries of the vertical joint grooves.

According to the method for manufacturing a siding board, the vertical joint grooves are formed through an embossing process so that it is possible to form the vertical joint grooves easily and reliably.

Since the lower concave portions are formed through an embossing process and a grinding process is performed in the above-described manner after curing of the cement, it is possible to form the lower edges of the siding board to be at different heights with the boundaries of the vertical joint grooves. Thus, it is possible to form the lower edges easily at different heights without an apprehension of deforming of the siding board.

It is particularly possible to eliminate the apprehension of causing deformations in the siding board when manufacturing a long siding board.

Since the lower concave portions are formed to be different vertical widths with the boundaries of the joint concave portions, the lower edges may be formed at different heights with the boundaries of the vertical joint grooves.

With this arrangement, it is possible to exhibit an external appearance as if a plurality of differently sized single plates were mounted and to obtain a large variety of touching designs of external appearance of the completed clapboard boarding structure when employing thus obtained siding boards.

Since the siding boards may be siding boards of large dimensions with a shape as if a plurality of single plates were integrated, construction thereof is made easy.

Since the siding boards are ceramic type siding boards, they have superior weatherability and durability. Various concave and convex patterns may be easily formed on designed surfaces thereof, and it is accordingly possible to obtain a large variety of designs of external appearance.

As discussed above, according to the present invention, it is possible to provide a method for manufacturing a siding board for clapboard boarding that may be easily manufactured, with which it is possible to easily construct a clapboard boarding structure that is of superior external-appearance design, weatherability and durability.

According to the other aspect of the invention, there is provided a clapboard boarding structure in which a plurality of siding boards are installed to a framework of a building such that lower side portions of upper siding boards are overlapped frontward of upper side portions of lower siding boards, wherein the siding boards are ceramic type siding boards, each of the siding boards including vertical joint grooves on a designed surface, lower edges of a lower side portion formed at different heights with boundaries of the vertical joint grooves, a rear surface stepped portion formed on the lower side portion, which have been obtained by notching the rear surface of the siding board, and an upper end surface of the rear surface stepped portion formed to extend in a substantially straight line in a lateral direction; and wherein each of the upper side portions of lower siding boards is disposed at the rear surface stepped portion formed on each of the lower side portions of upper siding boards.

In the siding board, the vertical joint grooves are formed on the designed surface of it, and the lower edges of the lower side portion are formed at different heights with boundaries of the vertical joint grooves. Thus, the designed surface of the siding board is partitioned by the vertical joint grooves. Moreover, respective lower ends of the parts of the partitioned designed surface are disposed at different positions. In the clapboard boarding structure, the lower edges of the siding boards are exposed when in a constructed condition. Thus, it is possible to obtain a clapboard boarding structure that exhibits an external appearance as if a plurality of single plates of different sizes were mounted, that is touching and rich in variation, and is of superior external-appearance design.

Since the siding boards may be long siding boards of a shape as if a plurality of single plates were integrated, construction thereof is made easy.

Since the siding boards are ceramic type siding boards, the clapboard boarding structure can exhibit superior weatherability and durability. Moreover, since various concave and convex patterns may be easily formed on the designed surfaces, it is possible to obtain a large variety of external-appearance design.

Since the upper side portions of lower siding boards are disposed at the rear surface stepped portions that are formed on the lower side portions of upper siding boards, it is possible to construct a clapboard boarding structure easily and reliably.

Since the upper end surfaces of the rear surface stepped portions are formed to extend in a substantially straight line in lateral directions, the rear surface stepped portions may be easily formed through a grinding process or others, and the siding boards may thus be easily manufactured.

As discussed above, it is possible to provide a clapboard boarding structure that is of superior external-appearance design, weatherability and durability and is easily manufactured.

BRIEF DESCRIPTION OF THE DRAWINGS

A more complete appreciation of the invention and many of the attendant advantages thereof will become readily apparent with reference to the following detailed description, particularly when considered in conjunction with the companying drawings, in which.

DESCRIPTION OF THE PREFERRED EMBODIMENTS

Figure 1:
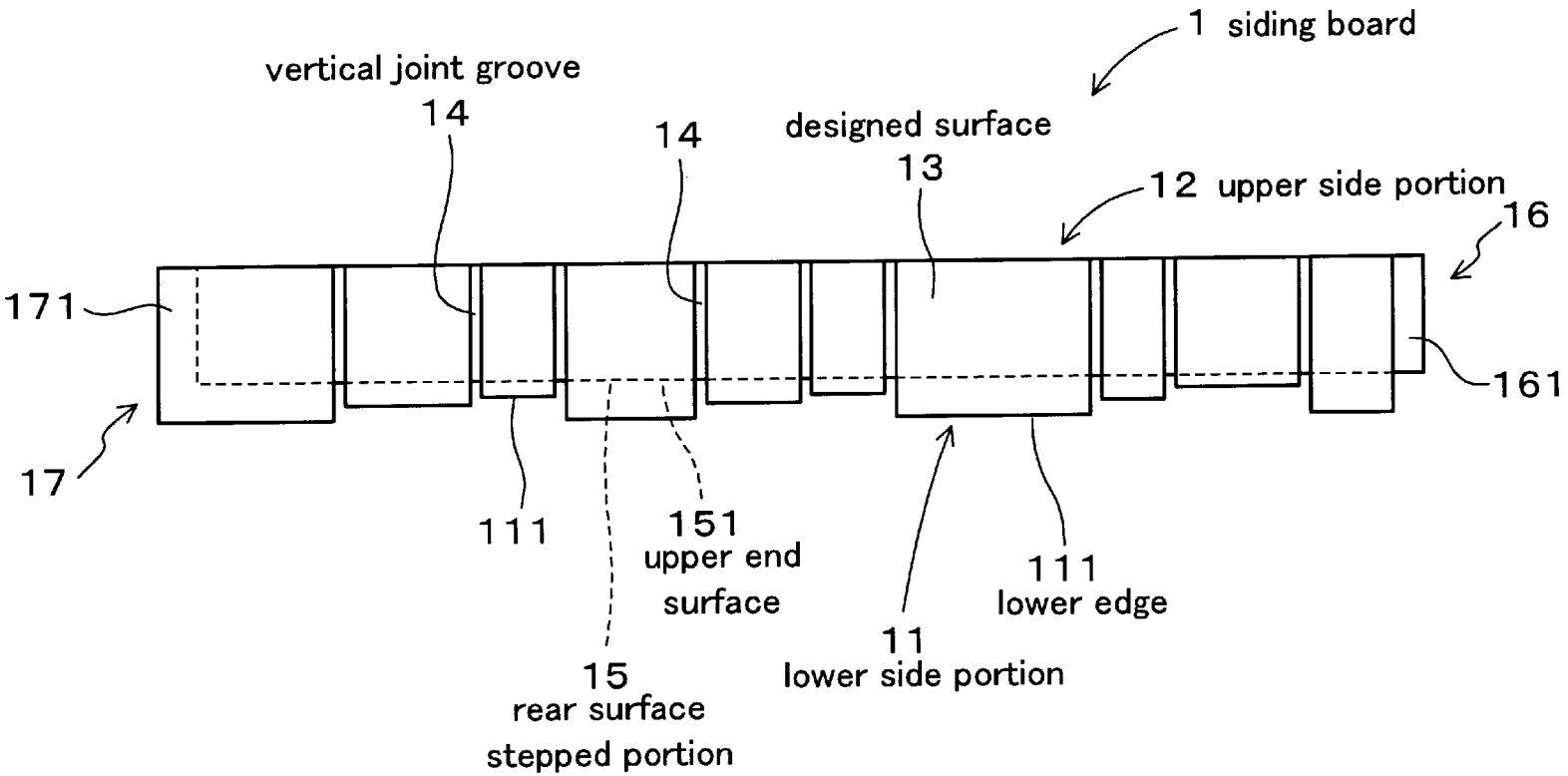
FIG. 1 is a front view of a siding board for clapboard boarding according to a first embodiment.

A "height" of the lower edge means a height in vertical direction when the siding board is installed to the framework.

The siding boards maybe fastened to the framework by means of, for instance, fastening members.

It is preferable that the siding board for clapboard boarding has an engaging groove formed at an upper end surface of a rear surface stepped portion, which has been obtained by notching the upper end surface, and engaging notches formed at an upper side portion, which have been obtained by notching the designed surface of the siding board; that the engaging groove is configured to engage with upper-board engaging portions of fastening members for fastening the siding board to the framework; and that the engaging notches are configured to engage with lower-board engaging portions of the fastening members.

In this manner, it is possible to obtain a siding board that may be fastened to the framework in a still easier and more reliable manner.

The fastening member may be comprised of, for instance, a base plate portion that is fixed to the framework, a supporting portion rising frontward from the base plate portion, an upper-board engaging portion upwardly bent from a front end of the supporting portion and a lower-board engaging portion downwardly bent from the front end of the supporting portion.

The term "green sheet" means a cement slurry that is formed in a sheet-shape to be used for forming a cement plate.

It is preferable that the method for manufacturing a siding board for clapboard boarding includes the steps of forming the engaging groove by grinding down upwardly the upper end surface of the rear surface stepped portion of the embossed board and forming the engaging notches at the upper side portion of the embossed board by grinding down the designed surface.

In this case, the upper-board engaging portion of the fastening member for fastening the siding board to the framework may be engaged with the engaging groove while the lower-board engaging portion of the fastening member may be engaged with the engaging notch. With this arrangement, it is possible to obtain a siding board that may be fastened to the framework in a still easier and more reliable manner.

It is further preferable that the method for manufacturing a siding board for clapboard boarding includes the steps of embossing a green sheet of large width from which a plurality of siding boards can be formed and separating the embossed board into several boards after curing of cement.

In this manner, it is possible to achieve a method for manufacturing a siding board of superior manufacturing efficiency.

It is preferable in the clapboard boarding structure that the siding boards are fastened to the framework of the building by fastening members, in which each of the siding boards has an engaging groove formed at the upper end surface of the rear surface stepped portion, which has been obtained by notching the upper end surface upwardly, and engaging notches formed at the upper side portion, which have been obtained by notching the designed surface; that each of the fastening members comprises a base plate portion that is fixed to the framework, a supporting portion rising frontward from the base plate portion, an upper-board engaging portion upwardly bent from a front end of the supporting portion and a lower-board engaging portion downwardly bent from the front end of the supporting portion; and that each of the upper-board engaging portion is engaged with the engaging groove of the upper siding board and each of the lower-board engaging portion is engaged with the engaging notches of the lower siding board.

With this arrangement, it is possible to obtain a siding board that may be fastened to the framework in a still easier and more reliable manner. It is accordingly possible to obtain a clapboard boarding structure that may be more easily constructed.

Embodiment 1

The siding board for clapboard boarding and the clapboard boarding structure according to one embodiment of the present invention will now be explained with reference to FIGS. 1 to 10.

Figure 4:
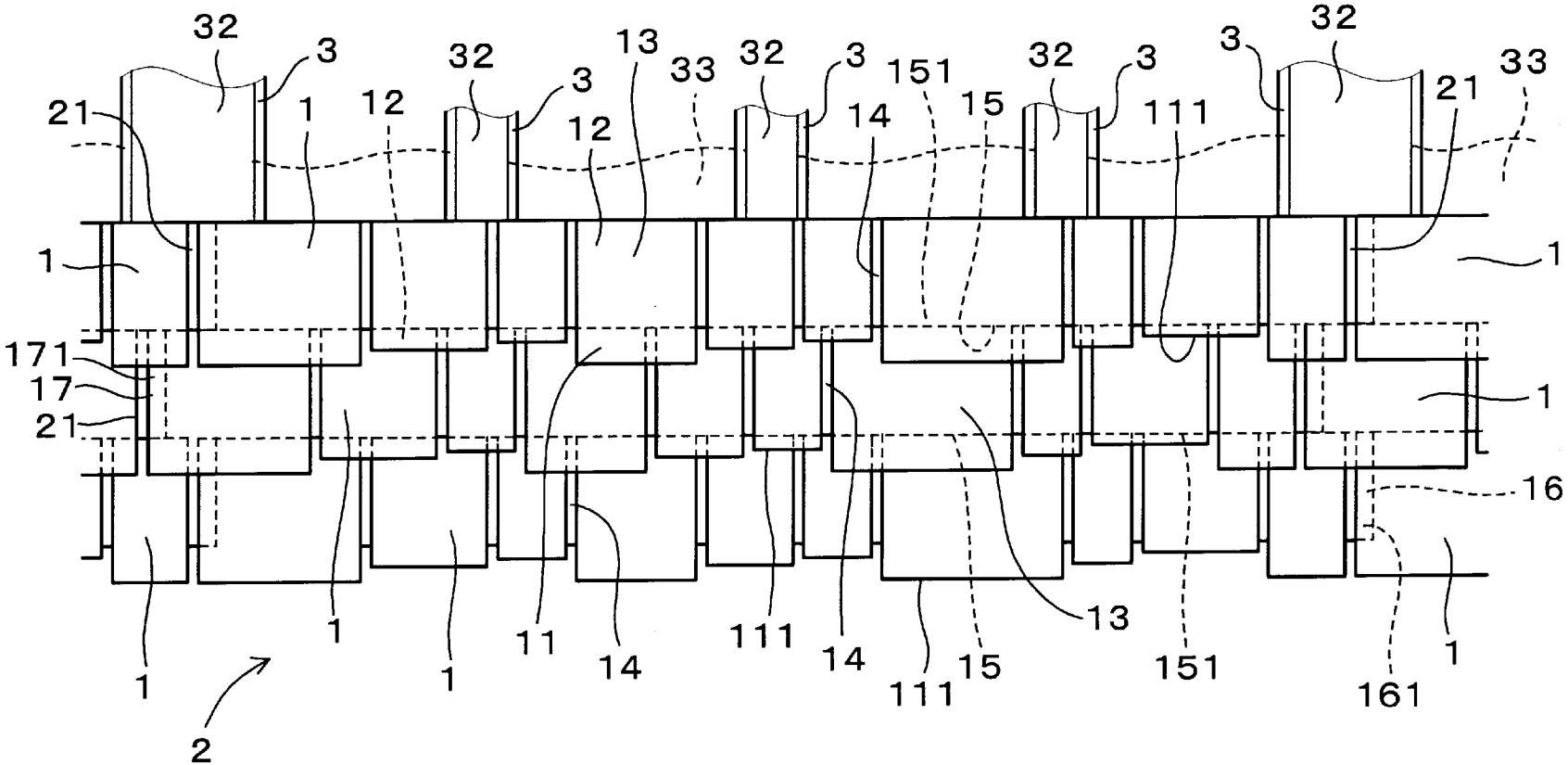
FIG. 4 is a front view of a clapboard boarding structure according to the first embodiment.
Figure 5:
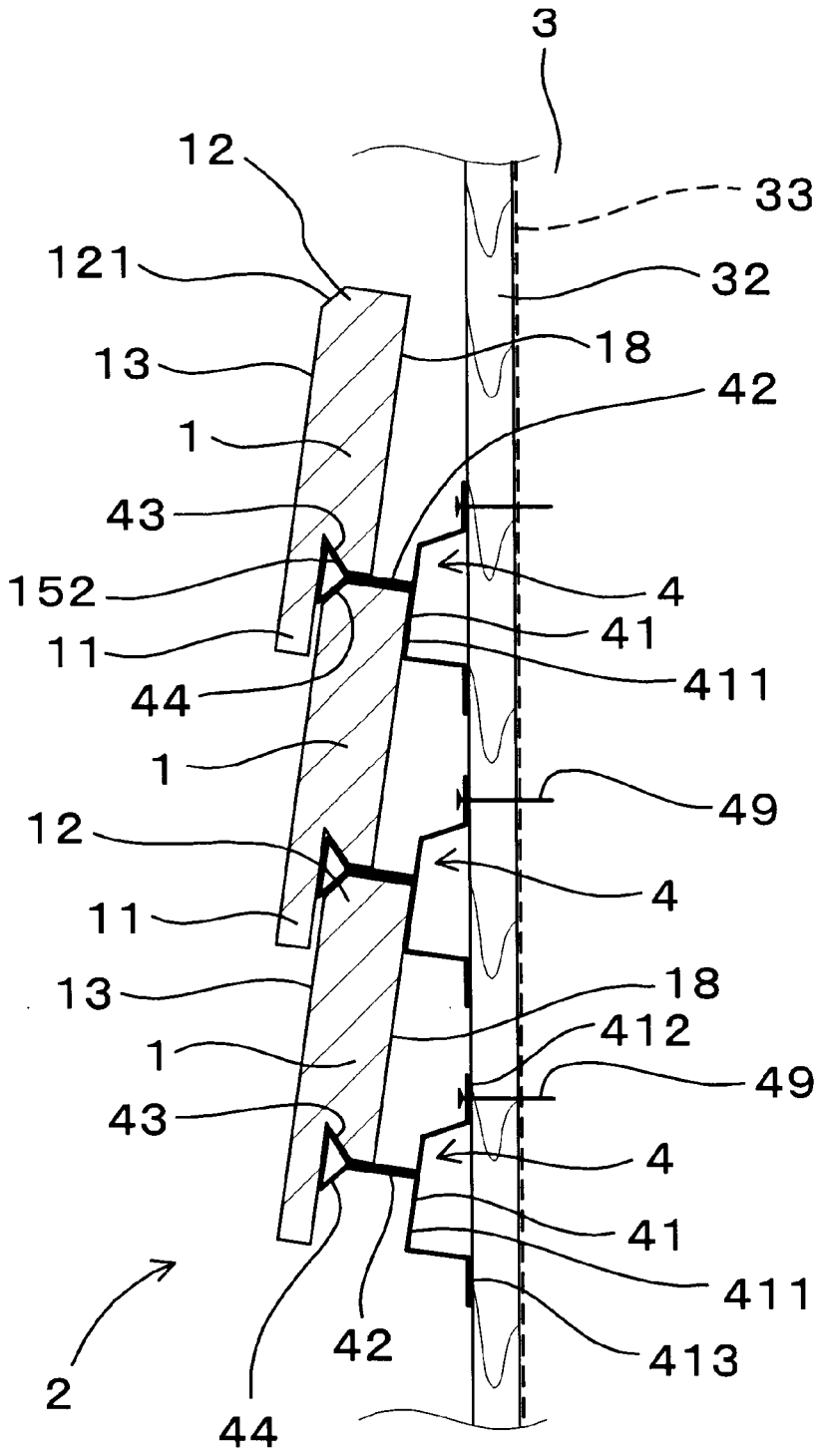
FIG. 5 is a vertical sectional view of the clapboard boarding structure according to the first embodiment.

The siding board 1 of the present example is a siding board for clapboard boarding as illustrated in FIGS. 4 and 5 employed in a clapboard boarding structure 2 in which lower side portions 11 of upper siding boards 1 are overlapped frontward of upper side portions 12 of lower siding boards 1 for installing the plurality of siding boards 1 to a framework 3 such as a column of a building.

Figure 2:
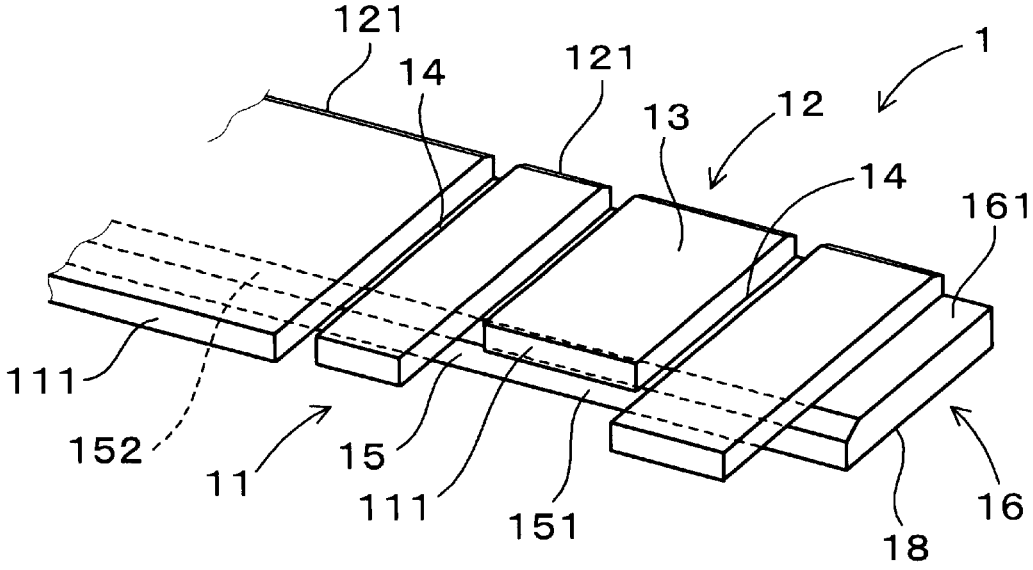
FIG. 2 is a perspective view of the siding board for clapboard boarding according to the first embodiment.

As illustrated in FIGS. 1 and 2, the siding board 1 is a ceramic type siding board with vertical joint grooves 14 formed on designed surfaces 13.

Lower edges 111 of the lower side portion 11 of the siding board 1 are formed at different heights with boundaries of the vertical joint grooves 14.

Figure 3:
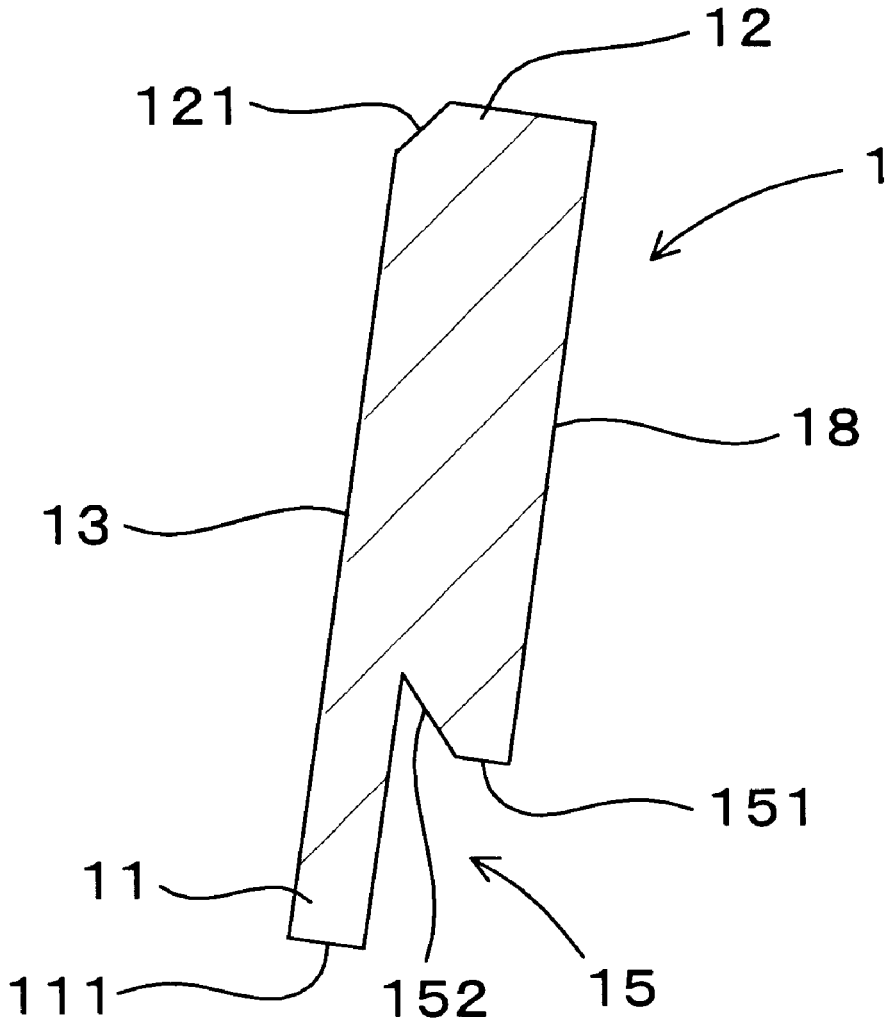
FIG. 3 is a vertical sectional view of the siding board for clapboard boarding according to the first embodiment.

As further illustrated in FIGS. 2 and 3, a rear surface stepped portion 15 that has been obtained by notching a rear surface 18 is formed at the lower side portion 11, and an upper end surface 151 of the rear surface stepped portion 15 is formed in a substantially straight line in a lateral direction.

An engaging groove 152 that has been obtained by notching the upper end surface 151 is formed at the upper end surface 151 of the rear surface stepped portion 15; and engaging notches 121 that have been obtained by notching the designed surface 13 are formed at the upper side portion 12. As illustrated in FIG. 5, an upper-board engaging portion 43 of a fastening member 4 (to be discussed later) maybe engaged with the engaging groove 152. Further, a lower-board engaging portion 44 of the fastening member 4 may be engaged with the engaging notches 121.

The dimension of the siding board 1 may be such that it has a lateral length of 2,400 mm, a thickness of 12 mm, and vertical widths of 250 mm at the maximum and 150 mm at the minimum.

It should be noted that the vertical joint grooves 14 of this embodiment are formed to have a shallow depth of approximately 1 to 2 mm. With this arrangement, it is possible to prevent leakage of water at the time of rainstorms in a more reliable manner.

The clapboard boarding structure 2 using such siding boards 1 will now be explained.

As illustrated in FIGS. 4 and 5, in the clapboard boarding structure 2, the lower side portions 11 of upper siding boards 1 are overlapped frontward of the upper side portions 12 of lower siding boards 1 for installing the plurality of siding boards 1 to the framework 3 of the building.

The upper side portions 12 of the lower siding boards 1 are disposed on the rear surface stepped portions 15 formed on the lower side portions 11 of the upper siding boards 1.

As illustrated in FIG. 5, the siding boards 1 are fastened to the framework 3 of the building by means of fastening members 4.

Each fastening member 4 comprises a base plate portion 41 that is fixed to the framework 3, a supporting portion 42 rising frontward from the base plate portion 41, an upper-board engaging portion 43 upwardly bent from a front end of the supporting portion 42, and a lower-board engaging portion 44 downwardly bent from the front end of the supporting portion 42. The upper-board engaging portion 43 is engaged with the engaging groove 152 of the upper siding board 1 while the lower-board engaging portion 44 is engaged with the engaging notch 121 of the lower siding board 1.

The base plate portion 41 of the fastening member 4 includes an abutting portion 411 abutting a rear surface 18 of the lower siding board 1, an upper leg portion 412 abutting the framework 3 above the abutting portion 411, and a lower leg portion 413 abutting the framework 3 below the abutting portion 411. The abutting portion 411 is inclined such that its lower end portion is disposed closer to the front than its upper end portion when the fastening member 4 is fixed to the framework 3.

The fastening member 4 is fastened to the framework 3 at the upper leg portion 412 of the base plate portion 41 through nails 49 with an underlayment 32 such as a furring strip and water-proof paper 33 being interposed between. It should be noted that it is possible to employ screws or similar instead of the nails 49.

Figure 6A:
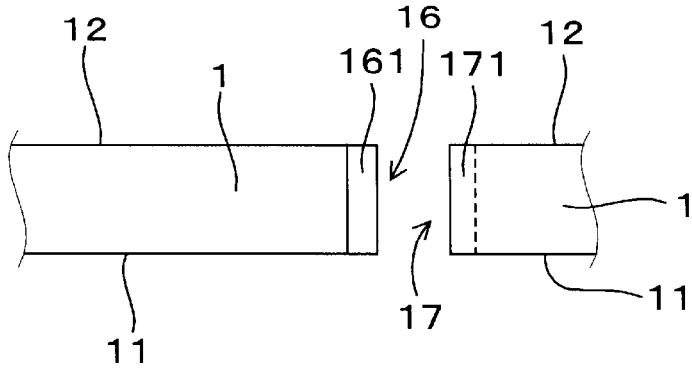
FIG. 6(A) is an explanatory front view of a left-right side shiplap joint of the siding boards according to the first embodiment.
Figure 6B:
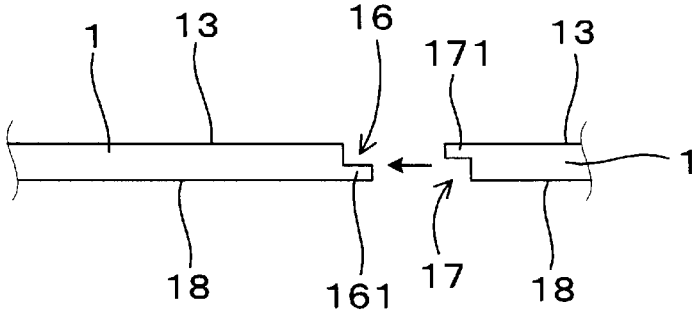
FIG. 6(B) is an explanatory view of a horizontal section of FIG. 6(A) viewed from the downside of FIG. 6(A)
Figure 6C:
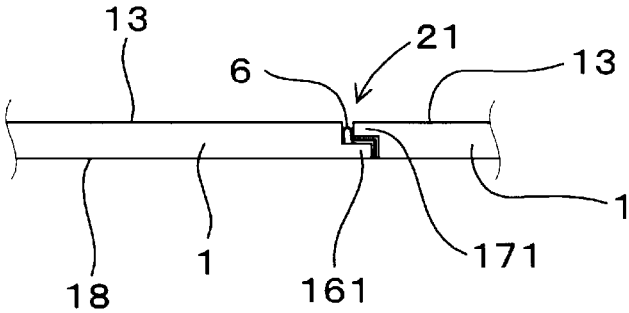
FIG. 6(C) is an explanatory view of the left-right side shiplap jointed siding boards following FIG. 6(B)

As illustrated in FIG. 1, the siding board 1 has a lateral underlying tongue portion 161 on a right side portion 16 and a lateral overlying tongue portion 171 on a left side portion 17. As illustrated in FIG. 6(A) and FIG. 6(B), the lateral overlying tongue portion 171 of the right sided siding board 1 places opposite the lateral underlying tongue portion 161 of the left sided siding board 1 installed on the framework 3 in advance. As illustrated in FIG. 6(C), the lateral overlying tongue portion 171 of a right sided siding board 1 is overlapped onto the lateral underlying tongue portion 161 of a left sided siding board 1 to be the left-right side shiplap joint.

Figure 7A:
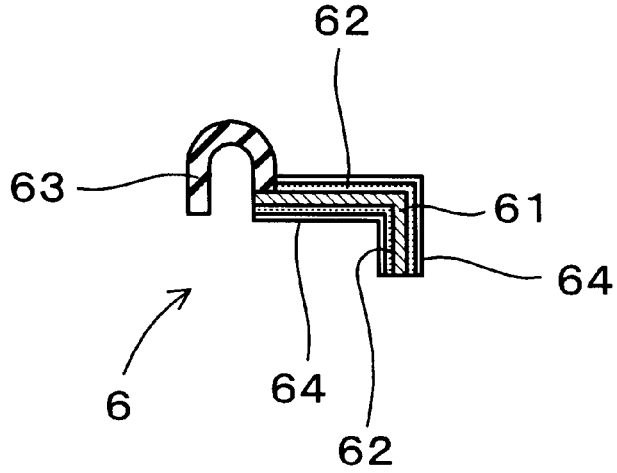
FIG. 7(A) is a sectional view of a joint member.
Figure 7B:
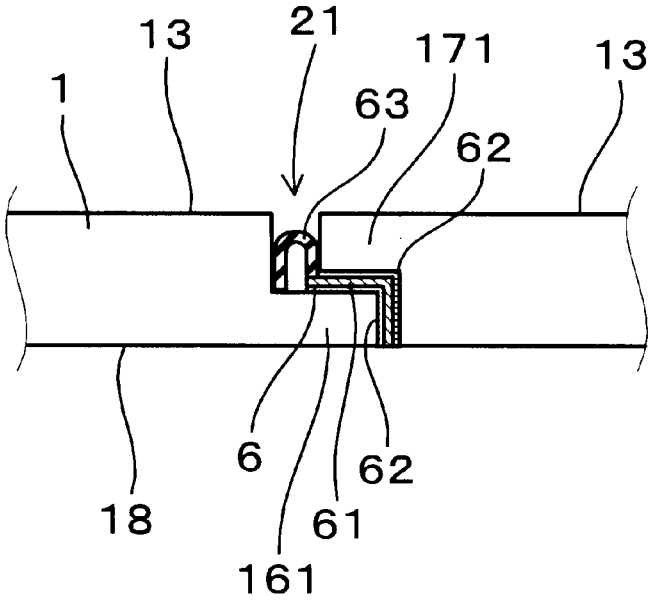
FIG. 7(B) is a sectional view of a connecting joint portion employing the joint member.

As illustrated in FIG. 7(B), a joint member 6 is provided at a joint portion of right and left siding boards 1 such that the joint member 6 is sandwiched between the lateral underlying tongue portion 161 and the lateral overlying tongue portion 171 in order to keep a constant distance between the right and left siding boards 1. As illustrated in FIG. 7(A), each joint member 6 is comprised of a steel plate 61 having a L-shaped section, adhesive 62 disposed on both surfaces of the steel plate 61, and elastic rubber 63 having a U-shaped section that is joined to one end of the steel plate 61. Prior to providing the joint members 6 on the siding boards 1, a parting paper 64 is adhered onto the surface of the adhesive 62. This parting paper 64 is peeled off immediately before disposing the joint members 6 to the siding board 1.

As illustrated in FIG. 7(B), the steel plate 61 of the joint members 6 is adhered to the lateral underlying tongue portion 161 and the lateral overlying tongue portion 171 of the siding board 1 with the adhesive 62, and the elastic rubber 63 is disposed to a connecting joint portion 21 between right and left siding boards 1.

As illustrated in FIG. 4, such connecting joint portions 21 are disposed in a laterally shifted manner between upper and lower siding boards 1. Accompanying this structure, the vertical joint grooves 14 of the siding boards 1 are disposed in laterally shifted manner between the upper and lower siding boards 1 and are not continued in a vertical manner.

The method for manufacturing the siding board 1 will now be explained.

Figure 8:
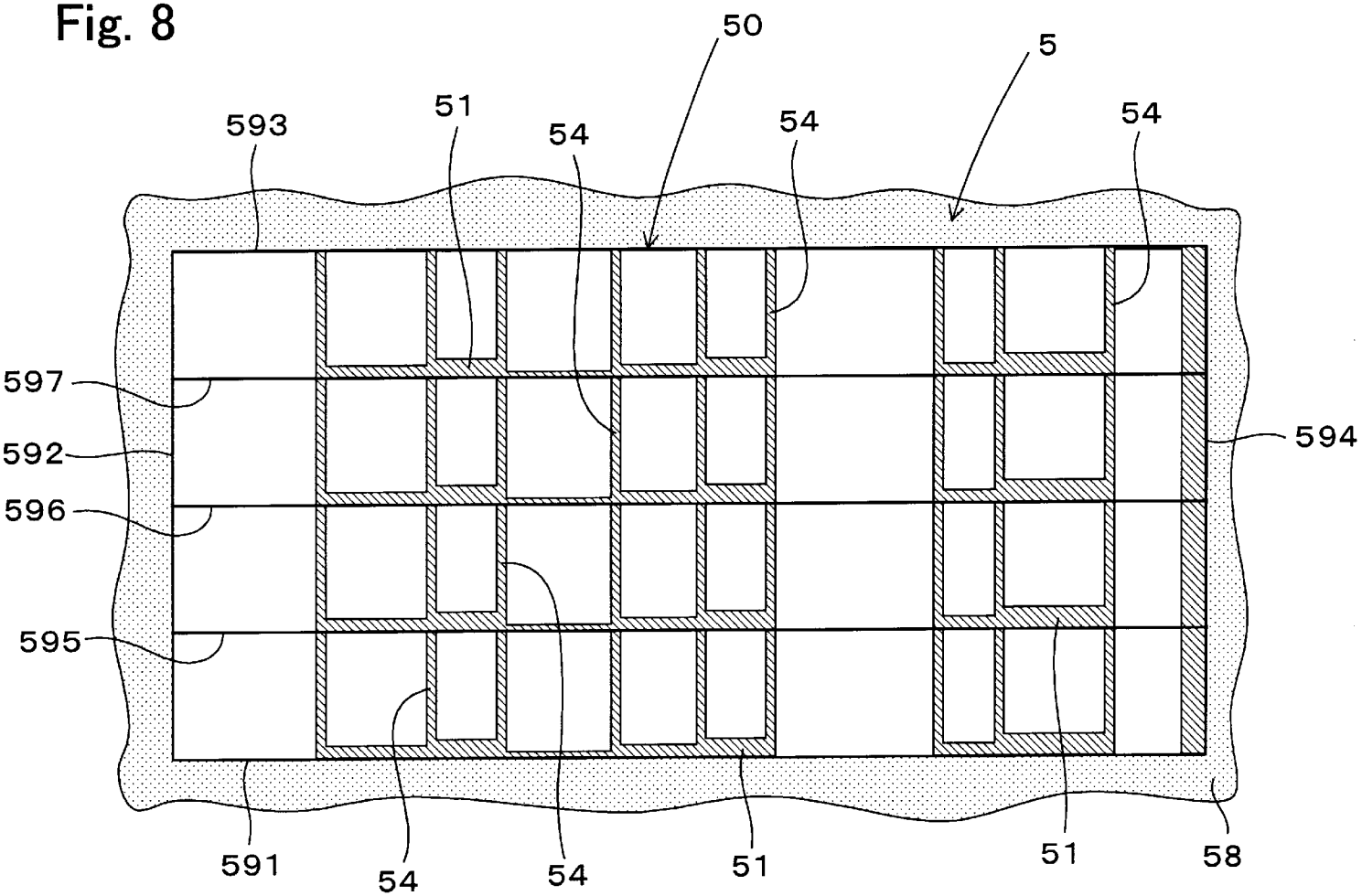
FIG. 8 is a front view of a green sheet which is embossed according to the first embodiment.

As illustrated in FIG. 8, joint concave portions 54 are formed at portions that are to be the vertical joint grooves 14 of the siding board 1, and lower concave portions 51 are formed downward of portions that are to be lower edges 111 of the siding board 1 by performing embossing of a green sheet 5 prior to curing of cement.

The lower concave portions 51 are formed to have different vertical widths with boundaries of the joint concave portions 54.

Figure 9:
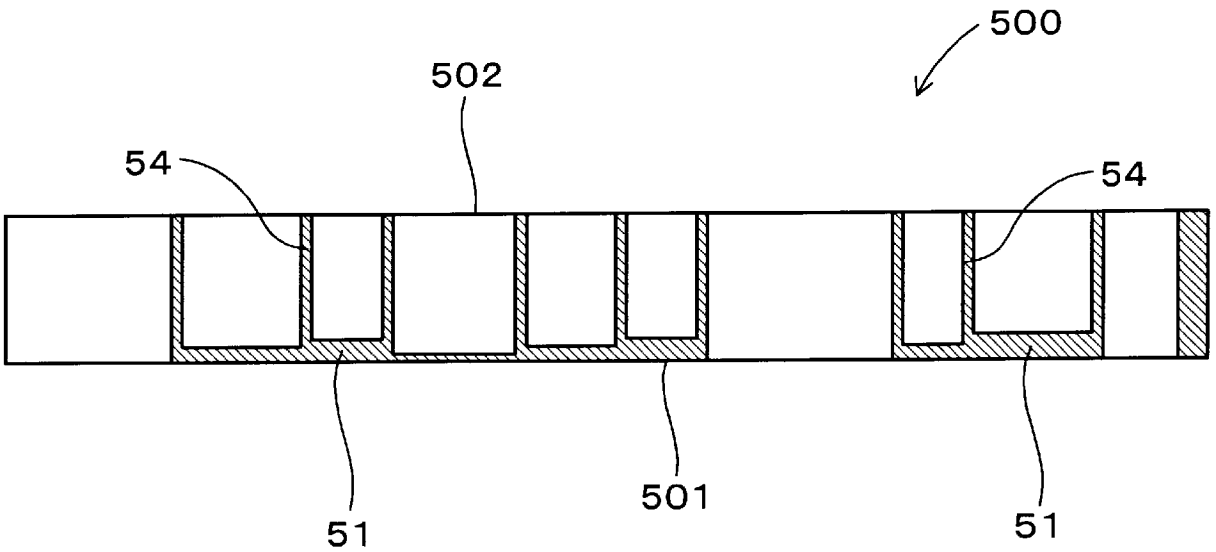
FIG. 9 is a front view of the embossed board according to the first embodiment after separation.

Embossing is performed by using a green sheet 5 from which four siding boards 1 may be formed as illustrated in FIG. 8, and after curing of cement, the embossed board 50 is cut and separated into four pieces (FIG. 9).

More particularly, the embossed board 50 which has been obtained by application of heat treatment, is cut at cutting lines 591, 592, 593, 594, 595, 596 and 597 shown in FIG. 8. In this manner, the embossed board 50 is separated into four pieces and excess portions at end portions 58 are removed.

Figure 10:
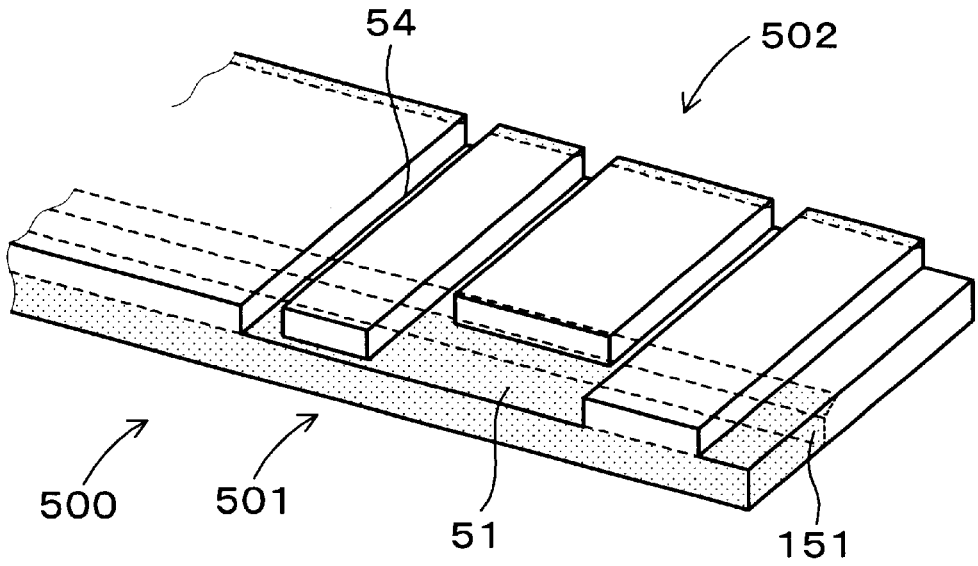
FIG. 10 is a perspective view of the embossed board according to the first embodiment after separation.

Thereafter, lower side portions 501 of the separated embossed boards 500 are ground down horizontally across the embossed board 500 from a rear surface side to reach a bottom surface of the lower concave portions 51 as illustrated in FIG. 10. In this manner, it is possible to form rear surface stepped portions 15 and lower side portions 11 with lower edges 111 located at different heights with the boundaries of the vertical joint grooves 14 as illustrated in FIGS. 2 and 3.

It should be noted that the hatching portions in FIG. 10 are portions to be removed through a grinding process.

At each embossed board 500, the engaging groove 152 is formed by grinding down the upper end surface 151 of the rear surface stepped portion 15 upwardly. On the other hand, at the upper side portion 502, engaging notches 121 (FIGS. 2, 3) are formed by grinding down the designed surface 13.

It should be noted that it is possible to grind down the rear surface stepped portion 15 and the engaging groove 152 at the same time.

Actions and effects of the present embodiment will now be explained.

As illustrated in FIG. 1, vertical joint grooves 14 are formed on a designed surface 13 of the siding board 1 and lower edges 111 of the lower side portions 11 are formed at different heights with the boundaries of the vertical joint grooves 14. Thus, the designed surface 13 of the siding board 1 is partitioned by the vertical joint grooves 14. Moreover, lower ends of the respectively partitioned designed surface 13 are disposed at different positions.

As illustrated in FIG. 4, such siding boards 1 are employed in constructing a clapboard boarding structure wherein their lower edges 111 are exposed in a constructed condition. It is accordingly possible to provide an external appearance upon construction as if a plurality of single plates of different sizes were mounted and it is possible to obtain a variety of structures for clapboard boarding 2 that is touching and of superior external-appearance design.

As illustrated in FIG. 1, since it is possible to obtain a long siding board 1 which has a shape as if a plurality of single plates were integrated, construction thereof is made easy.

Since the siding board 1 is a ceramic type siding board, they exhibit superior weatherability and durability. Moreover, since various concave and convex patterns may be easily formed on the designed surfaces 13, it is possible to obtain a large variety of external-appearance design.

As illustrated in FIGS. 2 and 3, a rear surface stepped portion 15 which is obtained by notching the rear surface 18 is formed on the lower side portion 11 of the siding board 1. Thus, by overlapping a rear surface stepped portion 15 of an upper siding board 1 onto the upper end portion 12 of a lower siding board 1, it is possible to construct a clapboard boarding structure 2 in an easy and reliable manner.

Since the upper end surface 151 of the rear surface stepped portion 15 is formed to extend laterally in a substantially straight line, the rear surface stepped portion 15 maybe easily formed through a grinding process. Therefore the siding board 2 can be manufactured in an easy manner.

The engaging groove 152 is formed at the rear surface stepped portion 15, and the engaging notch 121 is formed at the upper side portion 12. Upper-board engaging portions 43 of fastening members 4 for fastening the siding board 1 to the framework 3 is engaged with the engaging groove 152 while lower-board engaging portions 44 of the fastening members 4 are engaged with the engaging notches 121.

In this manner, it is possible to obtain the siding board 1 that may be fastened to the framework 3 in an easier and more reliable manner.

Since the lower side portions 11 of upper siding boards 1 are overlapped frontward of upper side portions 12 of lower siding boards 1 in the clapboard boarding structure 2, it is possible to prevent penetration of rainwater from joint portions between the upper and lower siding boards 1. As for the connecting joint portions 21 between the left and right siding boards 1, penetration of rainwater may be prevented through the joint members 6.

According to the method for manufacturing the siding board 1, the vertical joint grooves 14 are formed through embossing so that it is possible to form the vertical joint grooves 14 easily and reliably.

By forming the lower concave portions 51 through embossing and performing a grinding process in the above-described manner after curing of cement, it is possible to form lower edges 111 of the siding board 1 at different heights with the boundaries of the vertical joint grooves 14. It is accordingly possible to easily form the lower edges 111 at different heights without an apprehension of deforming of the siding board 1.

Particularly in case long siding boards 1 with lateral dimensions of not less than 1,200 mm are to be manufactured, there is no apprehension to cause deformations in the siding board 1.

Since the lower concave portions 51 are formed to be different vertical widths with the boundaries of the joint concave portions 54, it is possible to form the lower edges 111 at different heights with the boundaries of the vertical joint grooves 14.

By using the siding boards 1 obtained thereby, it is possible to obtain a clapboard boarding structure 2 that exhibit an external appearance as if a plurality of single plates of different sizes were mounted, that is touching and rich in variation, and is of superior external-appearance design.

As illustrated in FIGS. 8 and 9, since embossing is simultaneously performed by using a green sheet 5 of large width from which a plurality of siding boards 1 may be obtained, it is possible to achieve a method for manufacturing siding boards of superior production efficiency.

As explained so far, it is possible to provide a siding board for clapboard boarding that may be easily manufactured with which it is possible to easily construct a clapboard boarding structure of superior external-appearance design, weatherability and durability, a method for manufacturing the same, and a clapboard boarding structure that can be obtained by using the same.

Embodiment 2

Figure 11:
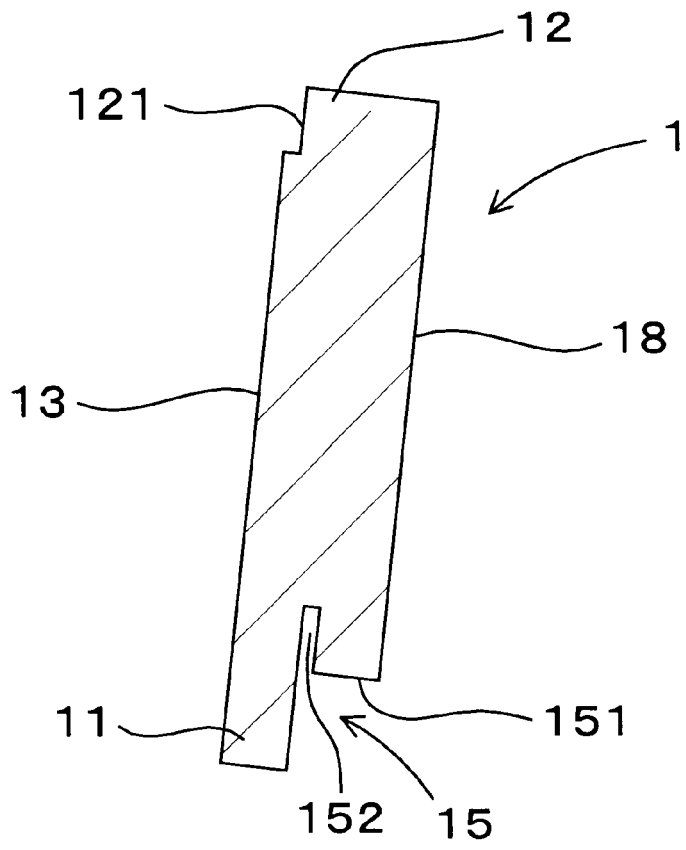
FIG. 11 is a vertical sectional view of the siding board for clapboard boarding according to a second embodiment.
Figure 12:
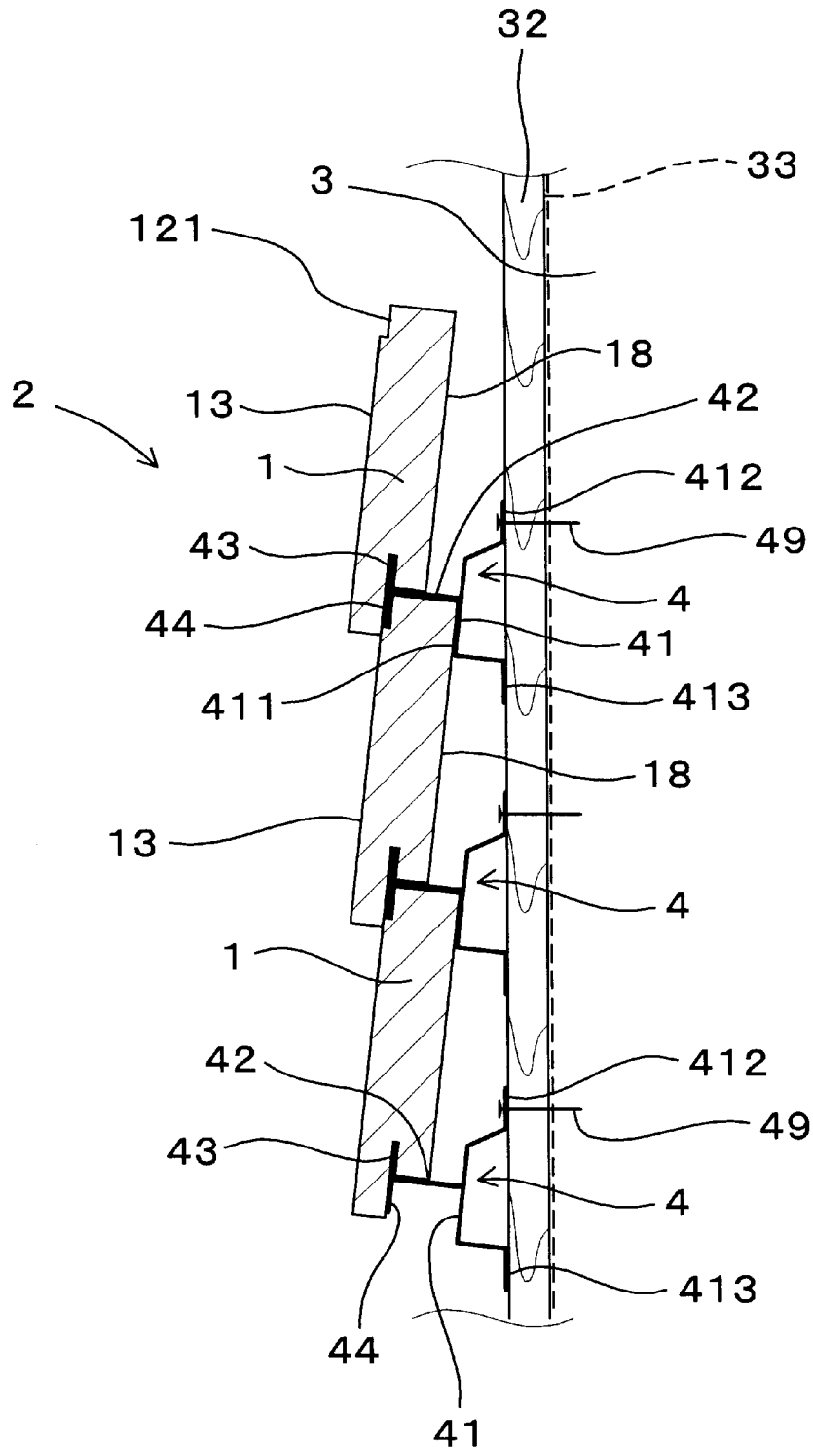
FIG. 12 is a vertical sectional view of a clapboard boarding structure according to the second embodiment.
Figure 13:
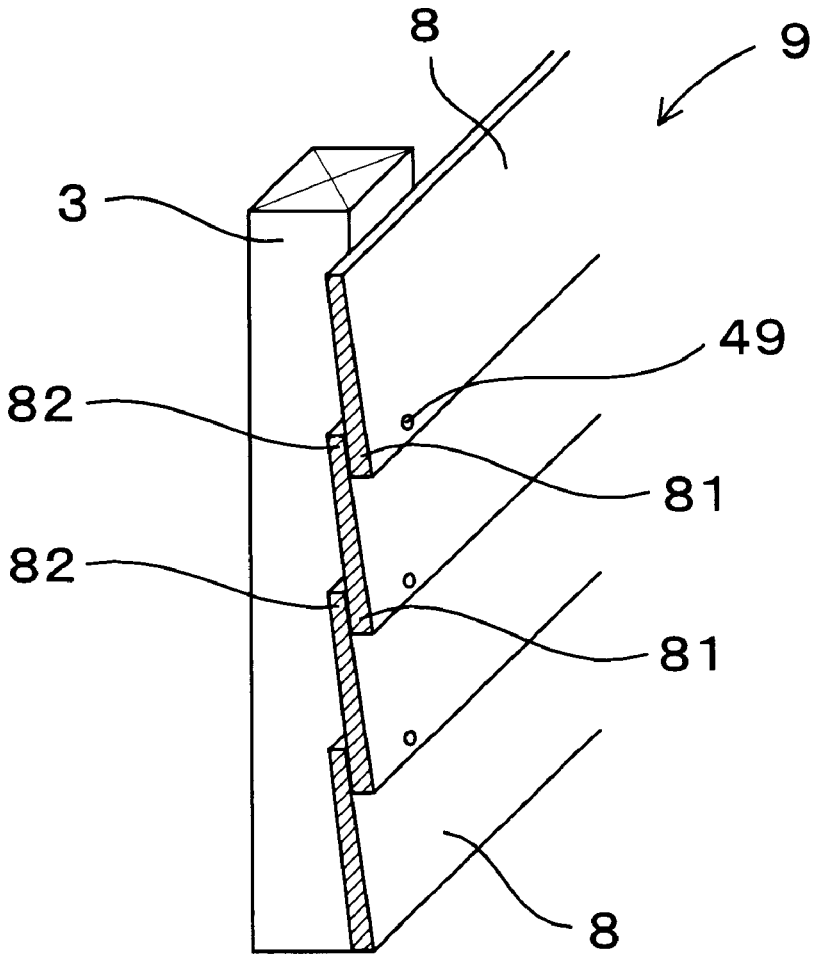
PRIOR ART Fig. 13
FIG. 13 is a perspective view of a clapboard boarding structure according to a prior art example.
Figure 14:
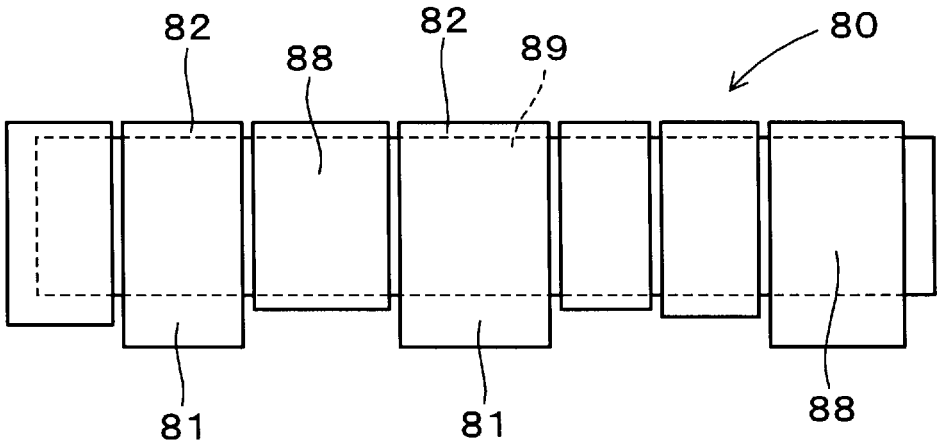
PRIOR ART Fig. 14
FIG. 14 is a front view of a siding board for clapboard boarding according to another prior art example.
Figure 15:
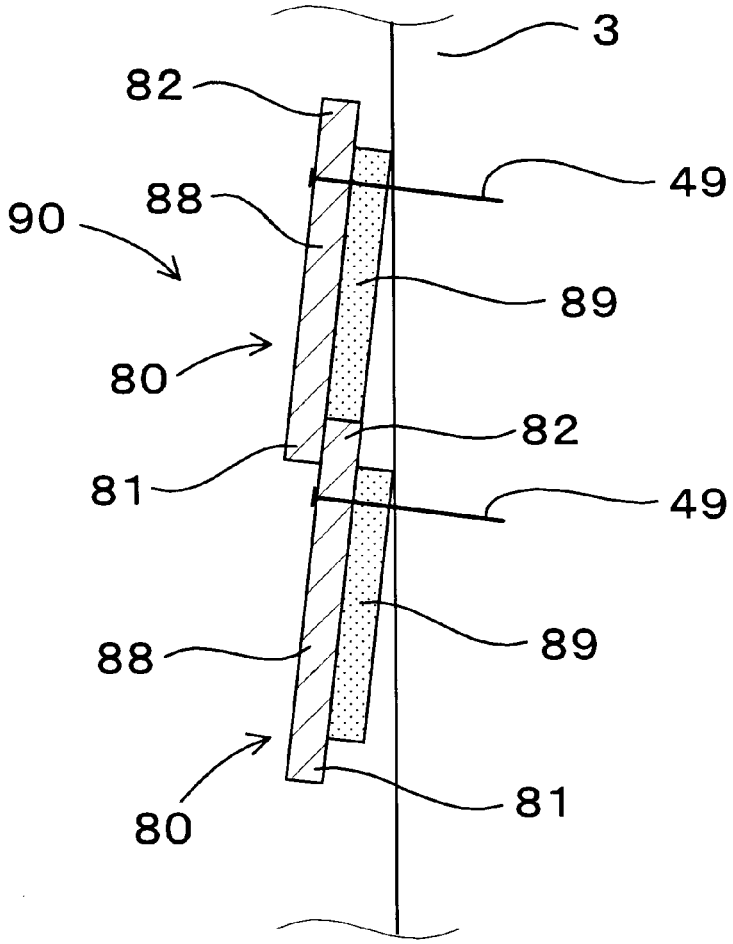
PRIOR ART Fig. 15
FIG. 15 is a vertical sectional view of the clapboard boarding structure according to another prior art example.
Figure 16:
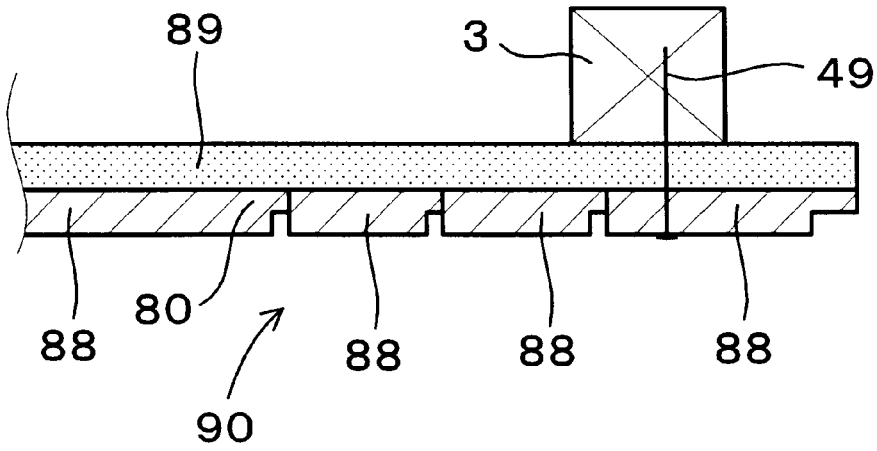
PRIOR ART Fig. 16
FIG. 16 is a lateral sectional view of the clapboard boarding structure according to another prior art example.

As illustrated in FIGS. 11 and 12, the present embodiment illustrates a case in which shapes of engaging notches 121 provided on the upper side portion 12 of the siding board 1 and a shape of an engaging groove 152 formed on a lower side portion 11 are varied from those of Embodiment 1.

More particularly, the engaging notches 121 are formed in a stepped-up manner to be retracted from the designed surface 13 by approximately 1 mm. The engaging groove 152 is formed to be a width of approximately 1.2 mm by upwardly notching the upper end surface 151 of the rear surface stepped portion 15.

In a fastening member 4 for fastening the siding board 1 to the framework 3, an upper-board engaging portion 43 and a lower-board engaging portion 44 are formed continuously to be vertical to supporting portion 42. With this arrangement, the upper-board engaging portion 43 may be engaged with an engaging groove 152 of an upper siding board 1 while the lower-board engaging portion 44 is engaged with the engaging notch 121 of a lower siding board 1, as illustrated in FIG. 12. The remaining arrangements are identical with those of Embodiment 1.

The same actions and effects as the Embodiment 1 may be exhibited also by the present embodiment.

Obviously, numerous modifications and variations of the present invention are possible in light of the above teachings. It is therefore to be understood that, within the scope of the appended claims, the invention may be practiced otherwise than as specifically described here.

What is claimed is:

1. A method for manufacturing a siding board for clapboard boarding that is employed in a clapboard boarding structure in which a plurality of siding boards are installed to a framework of a building such that lower side portions of upper siding boards are overlapped frontward of upper side portions of lower siding boards, the method comprising the steps of:

embossing a green sheet to make an embossed board prior to curing of cement for forming joint concave portions at portions that are to be vertical joint grooves of the siding boards and for forming lower concave portions below portions that are to be lower edges of the siding boards, in which the lower concave portions have different vertical widths with boundaries of the joint concave portions;

curing the cement of the embossed board; and grinding down the lower side portions of the embossed board horizontally across the embossed boards from a rear surface side thereof up to a bottom surface of the lower concave portions to form rear surface stepped portions and to form lower side portions of the siding board having lower edges at different heights with boundaries of the vertical joint grooves.

2. The method for manufacturing a siding board for clapboard boarding as claimed in claim 1, further comprising the steps of:

forming an engaging groove by grinding down upwardly an upper end surface of the rear surface stepped portion of the embossed board, and forming engaging notches at the upper side portion of the embossed board by grinding down a designed surface.

3. The method for manufacturing a siding board for clapboard boarding as claimed in claim 1, further comprising the steps of:

embossing a green sheet of large width from which a plurality of siding boards can be formed, and separating the embossed board into several boards after curing of cement.

* * * * *